United States Patent [19]

Kott

[11] 4,321,731

[45] Mar. 30, 1982

[54] METHOD AND APPARATUS FOR DRIVING CARD FLATS

[75] Inventor: Hermann Kott, Monchen-Gladbach, Fed. Rep. of Germany

[73] Assignee: Trützschler GmbH & Co. KG, Monchen-Gladbach, Fed. Rep. of Germany

[21] Appl. No.: 163,078

[22] Filed: Jun. 26, 1980

[30] Foreign Application Priority Data

Jul. 3, 1979 [DE] Fed. Rep. of Germany ..... 2926812

[51] Int. Cl.[3] ..... D01G 15/36; D01G 15/78

[52] U.S. Cl. ..... 19/102; 19/111

[58] Field of Search ..... 19/102, 103, 110, 111, 19/113, 108

[56] References Cited

U.S. PATENT DOCUMENTS

| | | | |
|---|---|---|---|
| 291,471 | 1/1884 | Dennis | 19/111 |
| 325,566 | 9/1885 | Potter | 19/111 |
| 1,146,065 | 7/1915 | Greer et al. | 19/102 |
| 1,363,094 | 12/1920 | Draper | 19/111 |

FOREIGN PATENT DOCUMENTS

| | | | |
|---|---|---|---|
| 2053994 | 2/1981 | United Kingdom | 19/111 |

*Primary Examiner*—Louis Rimrodt
*Attorney, Agent, or Firm*—Spencer & Kaye

[57] ABSTRACT

An arrangement for driving the traveling flats of a carding machine. A drive gear is readily releasably secured to the carding machine at one end of the flats for driving the flats in one revolving direction and, for driving the flats in another revolving direction, the drive gear is removed from the one end of the flats and readily releasably secured at the other end of the flats.

10 Claims, 3 Drawing Figures

METHOD AND APPARATUS FOR DRIVING CARD FLATS

BACKGROUND OF THE INVENTION

This invention relates to a method and an apparatus for driving revolving flats of a carding machine. The apparatus includes a drive gear which rotates the flat driving wheels and which is mounted on the carding machine.

In the manufacture of combed yarns, the short fibers are removed by a combing machine which is situated between a carding machine and a drawing frame. The combing machine can be assisted by removing a large proportion of the flat strips in the carding machine. The flat strips which are removed at the discharge side (front side) of the carding machine from the flat chain traveling with the carding cylinder, is substantially cleaner in appearance than the flat strips removed at the licker-in side (rear side) of the carding machine from the flats, when the latter slowly move in a direction opposite to that of the carding cylinder. It is a disadvantage of the prior art arrangement that the flats cannot be made to run in the opposite direction on short notice. In known carding machines, for running the flats in the opposite direction, all components of the revolving flats, that is, a great number of driving elements, guiding elements and deflecting elements have to be disassembled and then reassembled which is very time-consuming and thus a prompt reversal of the revolving direction of the flats is not feasible.

SUMMARY OF THE INVENTION

It is an object of the invention to provide an improved method and apparatus of the above-outlined type which permits a prompt reversal of the revolving direction of the flats.

This object and others to become apparent as the specification progresses, are accomplished by the invention, according to which, briefly stated, the drive gear for the flats is readily detachably mounted on the carding machine so that the drive gear may be arranged either in the zone of the flat carrier disc at the intake side of the carding cylinder or in the zone of the flat carrier disc at the outlet side of the carding cylinder.

By virtue of the feature that the drive gear for the flats is readily removably mounted on the card, it is feasible in a simple manner to arrange the drive gear either at the rear or at the front flat carrier disc. Thus, a prompt reversal of the traveling direction of the flats is possible and consequently, a time-consuming disassembling and assembling of the individual components of the revolving flats are no longer necessary.

The drive gear for the flats is—for the purpose of reversing the traveling direction of the flats—according to the invention disconnected from one of the flat drive shafts, for example, the front drive shaft; the input pulley of the drive gear is relocated from the one side of the drive gear to the opposite side thereof; the drive gear is turned 180° about a vertical axis and is mounted at the opposite (rear) flat drive shaft. Expediently, the drive gear is relocated in such a manner that the distance of the input pulley from the drive shaft of the carding cylinder remains the same in order to ensure that the belt tension does not change. Preferably, the drive gear is relocated together with other components coupled with the output side of the drive such as flat carrier disc, flat drive wheels and drive shaft.

The apparatus for performing the above-outlined method comprises a belt pulley (input pulley) and a drive gear which drives the flat drive wheels and which is mounted on the carding machine. According to the invention, the apparatus includes a housing which accommodates the drive gear and which has two openings for the gear input shaft and two openings for the gear output shaft (which is the drive shaft for the flats). Further, the drive gear input shaft and the drive gear output shaft may be selectively mounted on opposite sides of the drive gear. The basic principle of the invention resides in that for a reversal of operation of the flats all that has to be done is to relocate the drive gear from the one end of the flats (for example, from the input side of the carding cylinder) to the other end thereof. Since, however, the carding cylinder always rotates in the same direction, for a reversal of the revolving direction of the flats it is necessary to also reverse the direction of rotation of the input and the output sides of the drive gear. This can be effected in a simple manner by turning around the drive gear housing by 180°, whereby the drive input shaft—which always rotates in the same direction—actuates the drive gear from the other, opposite side. Then, necessarily, the drive gear output shaft will rotate in the opposite direction. By means of the dual measure, that is, by turning around the drive gear by 180° and by relocating the input and the output shafts from the one side to the respective opposite side of the drive gear, it is achieved that the input shaft continues to rotate in the same direction as the carding cylinder, while the output shaft has reversed its direction of rotation.

Expediently, the drive gear is mounted on a side wall, a frame or other component of the carding machine by means of a support member which is preferably shiftably secured to a component of the carding machine, e.g., by a slot and securing bolt combination. According to a preferred embodiment of the invention, the support member is readily removably secured to the housing of the drive gear. Preferably, the housing is provided with an opening for an output shaft for a flat stripping roll. In this manner the drive gear operates not only the bars of the flats but also the flat stripping roll.

DESCRIPTION OF THE PREFERRED EMBODIMENT

Figure 1:
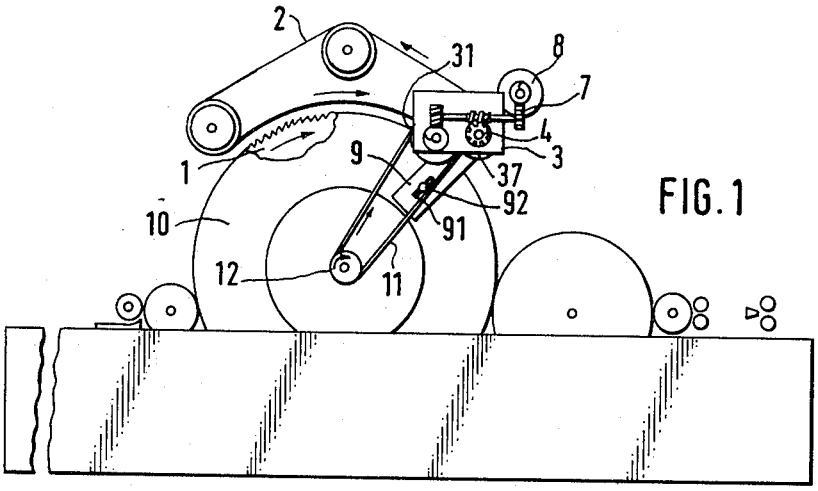
FIG. 1 is a schematic side elevational view of a preferred embodiment of the invention in a first operational mode.

Turning now to FIG. 1, there is shown a carding machine which has a clockwise-rotating main cylinder 1 and counterclockwise-revolving flats 2, so that the working flight of the flats conforming to the curvature of the cylinder 1 travels in the same direction as the cylinder 1. In the zone of that end of the flats which are on the discharge side (front side) of the carding cylinder 1 (that is, the right-hand side thereof as viewed in FIG. 1) a drive gear 3 is mounted which is driven by means of a clockwise-rotated belt pulley 31 which is coupled to a drive pulley 12 of the cylinder 1 by means of an endless belt 11. The belt pulley 31 is coupled with a counterclockwise-rotated front drive shaft 4 of the flats 2 by means of several transmission members of the gear 3, shown in more detail in FIG. 3 to be described as the specification progresses. By rotating the pulleys 12 and 31 in the same sense, the direction of rotation of the carding cylinder 1 and the revolving direction of the flats in the working zone are identical. Simultaneously, the drive gear 3 rotates, by means of a further drive element 7, a flat stripping roll 8 for the purpose of maintaining clean the clothing of the flat bars. A housing 37 of the drive gear 3 is secured by a support member 9 to a lateral side wall 10 of the carding machine by means of a bolt 92 passing through a slot 91 provided in the housing 37.

Figure 2:
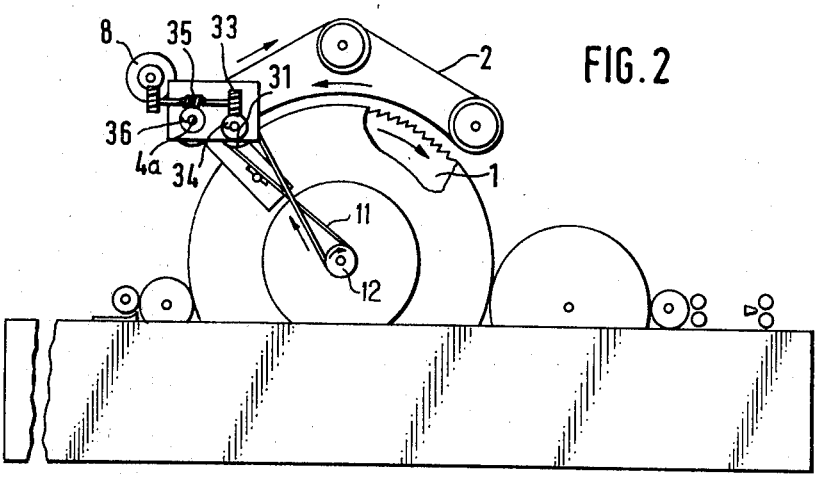
FIG. 2 is a schematic side elevational view of the same embodiment shown in a second operational mode.

Turning now to FIG. 2, the drive gear 3 is shown mounted in that end zone of the flats 2 which is at the input (rear) side of the carding machine. The belt pulley 31 is rotated counterclockwise, while the direction of rotation of the carding cylinder 1 and a rear drive shaft 4*a* of the flats is clockwise.

Figure 3:
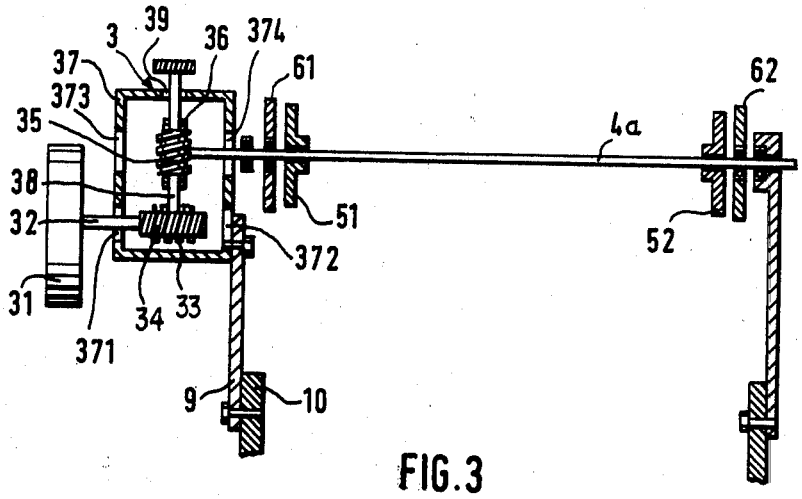
FIG. 3 is a schematic sectional top plan view of one part of the preferred embodiment in the operational mode shown in FIG. 2.

Turning now to FIG. 3, the walls of the housing 37 of the drive gear 3 are provided with aligned openings 371 and 372 and aligned openings 373 and 374. The drive pulley 31 is mounted on an input shaft 32 which also carries a worm 33. The worm 33 meshes with a pinion 34 which is mounted on a shaft 38 which also carries a worm 35. The latter meshes with a pinion 36 which is mounted on the rear output shaft (flats driving shaft) 4*a*. On the output shaft 4*a* there are mounted two flat driving wheels 51 and 52 as well as flat carrier discs 61 and 62. The housing 37 is provided with a further opening 39 through which the shaft 38 projects for the purpose of driving the flat stripping roll 8.

If, for reversing the direction of travel of the revolving flats, the drive gear 3 is to be relocated from the zone of the rear flat carrier disc (FIG. 2) into the zone of the front flat carrier disc (FIG. 1), the housing 37 of the drive gear 3 is removed from the card by disconnecting the support member 9 from the lateral wall 10. During this occurrence, the rear drive shaft 4*a* of the flats 2 is disconnected from the pinion 36 and pulled out through the opening 374. Thereafter the shaft 32, on which the belt pulley 31 is mounted, is released from the worm 33, then introduced through the opening 372 and connected with the other side (right side, as viewed in FIG. 3) of the worm 33. Then the housing 37 is mounted by means of the carrier arm 9 on the side wall 10 in the zone of the front flat carrier disc at the outlet (right-hand side as viewed in FIGS. 1 and 2) of the carding cylinder 1. During this operation the front drive shaft 4 of the flats 2 is introduced through the opening 373 and is coupled with the other side (left side, as viewed in FIG. 3) of the pinion 36.

It will be understood that the above description of the present invention is susceptible to various modifications, changes and adaptations, and the same are intended to be comprehended within the meaning and range of equivalents of the appended claims.

What is claimed is:

1. In a carding machine including a carding cylinder having an input side and an output side; traveling flats cooperating with the carding cylinder and having a rear end at the input side of the cylinder and a front end at the output side of the cylinder; a drive gear having a driven side including an input shaft for operative connection with a driven member and a driving side for operative connection with said flats for revolving said flats; the improvement comprising (a) a front drive shaft drivingly connected with the front end of said flats for driving said flats in a first revolving direction;

(b) a rear drive shaft drivingly connected with the rear end of said flats for driving said flats in a second revolving direction which is opposed to said first revolving direction;

(c) a first gear element forming part of said driven side of said drive gear; said first gear element having opposite sides to which said input shaft is selectively connectable;

(d) a second gear element forming part of said driving side of said drive gear and being operatively connected for rotation with said first gear element; said second gear element having opposite sides to which said front drive shaft or said rear drive shaft is selectively connectable; and (e) a housing accommodating said drive gear; said housing including means defining (1) a first and a second opening aligned with the respective opposite sides of said first gear element for providing passage for said input shaft of said drive gear; and (2) a third and a fourth opening aligned with the respective opposite sides of said second gear element for providing passage for said front drive shaft or said rear drive shaft, respectively.

2. A carding machine as defined in claim 1, further comprising mounting means for selectively and readily releasably attaching said housing with said drive gear to said carding machine at the front end or at the rear end of said flats for selectively coupling said drive gear to said front drive shaft or said rear drive shaft, respectively.

3. A carding machine as defined in claim 2, further comprising adjusting means for linearly adjustably securing said mounting means to said carding machine.

4. A carding machine as defined in claim 3, wherein said adjusting means comprises a slot provided in said mounting means and a bolt passing through said slot and tightenable to said carding machine.

5. A carding machine as defined in claim 2, wherein said mounting means is readily removably secured to said housing.

6. A carding machine as defined in claim 1, further comprising a flat stripping roll mounted in said carding machine and cooperating with said flats; a drive means for said flat stripping roll; and means defining a fifth opening in said housing to provide access for said drive means of said flat stripping roll to said drive gear for rotating said flat stripping roll.

7. In a method of driving traveling flats of a carding machine; the carding machine including a carding cylinder having input and output sides and a rotary axis; the flats having a rear end at said input side and a front end at said output side; and a drive gear for driving said flats; the improvement comprising the following steps:

(a) readily releasably securing said drive gear to said carding machine at one of said ends of said flats for driving said flats in one revolving direction; and (b) removing said drive gear from said one end of said flats and readily releasably securing said drive gear to said carding machine at the other of said ends of said flats for driving said flats in another revolving direction opposed to said one revolving direction.

8. A method as defined in claim 7, wherein said carding machine further includes a front drive shaft drivingly connected with the front end of said flats; a rear drive shaft drivingly connected with the rear end of said flats; an input shaft and a belt pulley attached to said input shaft; said belt pulley and said input shaft forming part of said drive gear; further comprising the following steps:

(c) disconnecting said drive gear from one of said drive shafts of said flats;

(d) relocating said input shaft and said drive pulley from one side of said drive gear to another, opposite side thereof;

(e) turning said drive gear 180° about a vertical axis after said step of removing said drive gear from said one end of said flats and before said step of securing said drive gear at said other end of said flats; and (f) securing said drive gear to said other of said drive shafts of said flats after step (e).

9. A method as defined in claim 8, wherein said carding machine further includes a flat stripping roll rotatably mounted for cooperating with said flats to remove waste therefrom; further comprising the step of maintaining an operative driving connection between said drive gear and said flat stripping roll in either location of said drive gear.

10. A method as defined in claim 8, further comprising the step of maintaining identical the distance between said belt pulley and said axis of said carding cylinder in either location of said drive gear.

* * * * *